US009440271B2

(12) United States Patent
Kipping et al.

(10) Patent No.: US 9,440,271 B2
(45) Date of Patent: Sep. 13, 2016

(54) DEVICE FOR STRAIGHTENING A FLOW FOR COOLING A ROLL OR A METAL STRIP

(71) Applicant: SMS Siemag AG, Duesseldorf (DE)

(72) Inventors: Matthias Kipping, Herdorf (DE); Johannes Alken, Siegen (DE); Ralf Seidel, Dillenburg (DE)

(73) Assignee: SMS GROUP GMBH, Duesseldorf (DE)

( * ) Notice: Subject to any disclaimer, the term of this patent is extended or adjusted under 35 U.S.C. 154(b) by 37 days.

(21) Appl. No.: 14/375,557

(22) PCT Filed: Jan. 31, 2013

(86) PCT No.: PCT/EP2013/051833

§ 371 (c)(1),
(2) Date: Oct. 7, 2014

(87) PCT Pub. No.: WO2013/113775

PCT Pub. Date: Aug. 8, 2013

(65) Prior Publication Data

US 2015/0020564 A1 Jan. 22, 2015

(30) Foreign Application Priority Data

Feb. 2, 2012 (DE) ..... 10 2012 201 496

(51) Int. Cl.
*B21B 45/02* (2006.01)
*B21B 27/10* (2006.01)

(52) U.S. Cl.
CPC ..... *B21B 45/0218* (2013.01); *B21B 27/10* (2013.01); *B21B 45/0233* (2013.01); *B21B 2027/103* (2013.01)

(58) Field of Classification Search
CPC ... B21B 27/06; B21B 27/083; B21B 27/086; B21B 27/10; B21B 27/106; B21B 2027/103; B21B 37/32; B21B 37/44; B21B 37/74; B21B 37/76; B21B 43/00; B21B 45/004; B21B 45/203; B21B 45/0209; B21B 45/0212; B21B 45/0215; B21B 45/0218; B21B 45/0233; B21B 45/0239; B21B 45/0245; B21B 45/0248; B21B 45/0251; B21B 45/0266; B21B 2261/20; B21B 2261/21; B21B 2267/12; B21B 2267/19; C21D 1/667; B05B 1/04; B05B 1/20
USPC ..... 72/200–202, 342.1, 342.2, 342.3, 342.7
See application file for complete search history.

(56) References Cited

U.S. PATENT DOCUMENTS 3,192,757 A * 7/1965 Diolot ..... B21B 27/10 72/201
3,671,028 A * 6/1972 Hemsath ..... B21B 45/0215 266/134

(Continued)

FOREIGN PATENT DOCUMENTS

BE 870 960 2/1979
DE 216 50 49 7/1972

(Continued)

*Primary Examiner* — Peter DungBa Vo
*Assistant Examiner* — Joshua D Anderson
(74) *Attorney, Agent, or Firm* — Abelman, Frayne & Schwab

(57) ABSTRACT

The invention is directed to a device for straightening a stream of a cooling medium for cooling a roll or a metal strip. This device comprise a hollow body, extending over at least part of the width of the roll or the metal strip, and a tube, arranged in the hollow body and extending in the direction of the width of the roll or the metal strip, wherein the hollow body is divided in the direction of the width of the roll or the metal strip into a number of chambers, and the tube comprises openings for introducing cooling medium into the chambers of the hollow body, and the chambers respectively comprise an opening for the flowing out of cooling medium from the hollow body. Furthermore, according to the invention the chambers, respectively, comprise a channel, formed between the inner wall of the hollow body and the tube, for conducting cooling medium from the openings of the tube to the opening for the outflow of cooling medium from the hollow body, wherein the flow cross-section of the channel narrows art least at its downstream end.

14 Claims, 4 Drawing Sheets

(56) References Cited

U.S. PATENT DOCUMENTS

Figure 1:
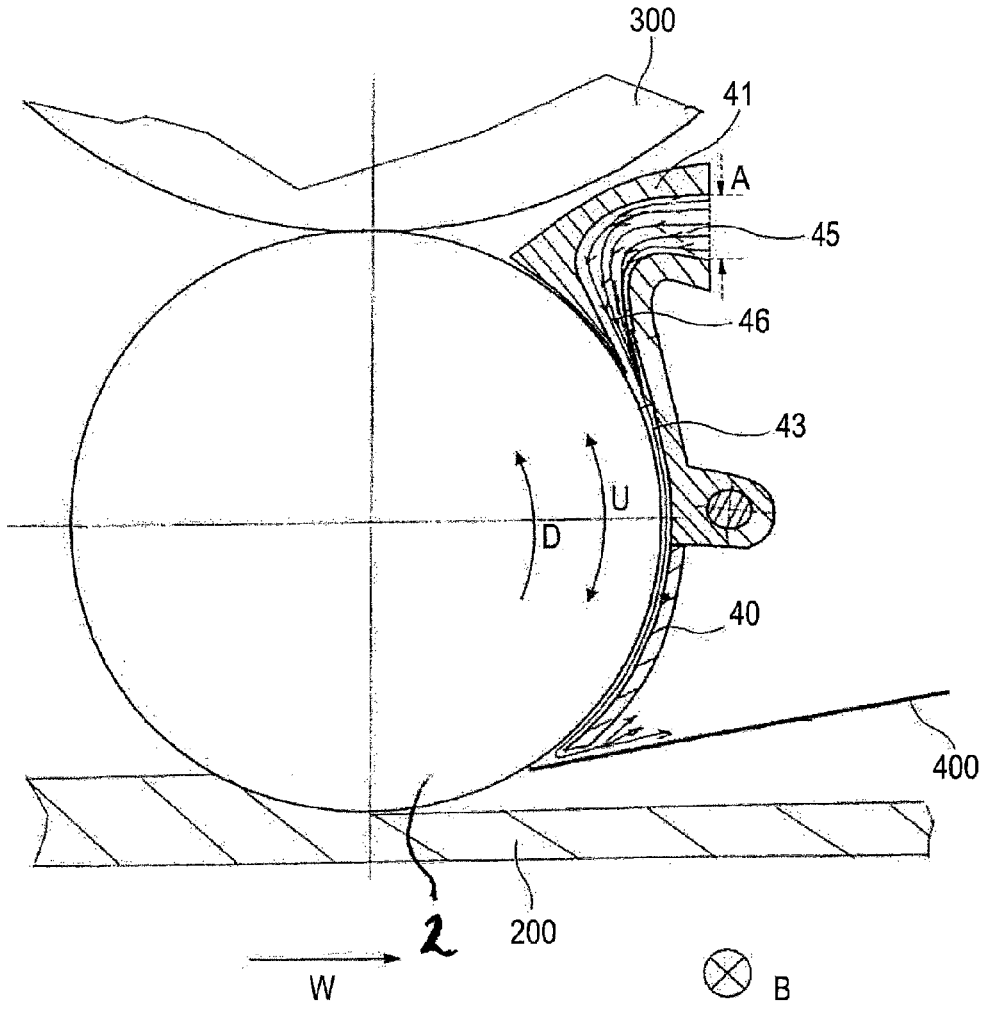

| | | | | |
|---|---|---|---|---|
| 4,076,222 | A * | 2/1978 | Schaming | B05C 5/005 118/DIG. 4 |
| 4,210,288 | A * | 7/1980 | Dobson | B05C 5/005 239/597 |
| 4,300,376 | A | 11/1981 | Wilmotte | |
| 4,486,009 | A * | 12/1984 | Kopf | B21B 45/0218 266/114 |
| 4,744,226 | A * | 5/1988 | Noville | B21B 45/0218 62/374 |
| 2013/0249150 | A1 * | 9/2013 | Matsumoto | B21B 39/16 266/114 |

FOREIGN PATENT DOCUMENTS

| | | |
|---|---|---|
| DE | 10 2011 104 735 | 12/2012 |
| GB | 1 336 490 | 11/1973 |
| GB | 2 068 807 | 8/1981 |
| JP | 01-181 913 | 7/1989 |
| JP | H01-110251 | 7/1989 |
| JP | 01-317 615 | 12/1989 |
| JP | H08-39110 | 2/1996 |
| JP | 10-192 944 | 7/1998 |
| JP | 11-057 837 | 3/1999 |
| JP | 2008-264597 | 11/2008 |
| UA | 35811 | 4/2001 |

* cited by examiner

DEVICE FOR STRAIGHTENING A FLOW FOR COOLING A ROLL OR A METAL STRIP

FIELD OF THE INVENTION

The present invention relates to a device for straightening a stream for cooling a roll or a metal strip or to a straightener. The present invention further relates to a device for cooling a roll or a metal strip.

STATE-OF-THE ART

State-of-the art discloses numerous cooling devices for cooling rolls, metal strips or metal sheets wherein, e.g., air, oil emulsion, or water is used.

In some cases, cooling medium is applied simply from cooling medium outlet to to-be-cooled rolls or to-be-cooled strips in large amounts. The drawback of this, among others, is the use of a large amount of cooling medium which either is lost for subsequent processes or is returned back and, possibly, must be treated at a great cost. A further drawback consists in a poor heat transmission rate per unit of volume to the applied cooling medium. Also, a controlled and varied degree of cooling in the width direction of the roll or strip is not possible with many known devices.

Other developed devices include spray bars which extend over the width of a strip or a roll. Such spray bars often include hollow bodies which are filled with cooling water and which include outlet openings along the width direction through which the cooling water can reach the strip.

Japanese Publication JP 11057837 A discloses an embodiment of a cooling device in which water from a vessel can be fed onto a metal strip through a slit extending in the width direction of the metal strip. The drawback of such constructions consists in that water is not applied to the metal trip in a controlled manner. The relative speed between the cooling water and the metal strip is low and the used water is not adequately used for cooling. In addition, the streams which exit such cooling devices, are very turbulent, not controlled, and/or have, when exiting, an increased thickness of the boundary layer. Turbulent cooling medium streams or cooling medium streams with a large thickness of the boundary layer result generally in a relatively poor heat transmission coefficient and, thus, decrease the cooling efficiency. A further drawback consists in that the produced streams cannot be adequately defined or calculated, whereby the control or regulation of the cooling becomes more difficult.

In summary, the object of the invention is to provide a device that would contribute to efficient cooling of a roll or a metal strip.

In particular, a device for straightening the stream should be provided that would insure that a less turbulent stream with a smaller boundary layer or a straightened stream can be produced.

A further object consists in providing an improved device for cooling a roll or metal strip.

Advantageously, at least one of the above-mentioned drawbacks should be eliminated.

DISCLOSURE OF THE INVENTION

The object of the invention is achieved by providing a device for straightening a cooling medium stream for cooling a roll or a metal strip according to claim 1. The device includes, advantageously, a hollow body extending at least over a portion of a width of the roll or the metal strip and a tube located in the hollow body and extending in a width direction (transverse to the cast or rolling direction) of the roll or the metal strip wherein the hollow body is divided in several chambers (segments) in the width direction of the roll or the metal strip, and the tube has openings for feeding the cooling medium from the tube in the chambers of the hollow body, and the chambers each has an opening for outflow of the cooling medium from the hollow body. According to the invention, the chambers each has a channel formed between an inner wall of the hollow body and the tube for conducting the cooling medium from the openings of the tube to the openings for outflow of the cooling medium from the hollow body, wherein a cross-section of the channel narrows at its downstream-located end or widens, looking in, at the downstream-located end.

With this arrangement and the provision of a narrowing shape of the channel, the fluid is accelerated and straightened. Thereby, the turbulence can be reduced and the boundary layer diminished. The term "boundary layer" is familiar to one of ordinary skill from the field of fluid dynamics. Mostly, the thickness of the boundary layer of a fluid stream is viewed as the thickness in which the streaming fluid has a velocity less than 99% of its free outer velocity. Further, by dividing the hollow body in several chambers (in the width direction), a straightening action is also achieved.

The openings of the tube are located preferably in all of the embodiments, at the side remote from the hollow body openings, so that the cooling medium leaves the tube in a flow direction opposite the outlet of the hollow body. After leaving the tube, the cooling medium is guided along the outer side of the tube in a reversed direction.

According to an advantageous embodiment, the tube is so arranged in an interior of the hollow body that the cooling medium flows around a greater part (more than half of its circumference) of the tube. Generally, the tube can be arranged substantially centrally relative to the hollow body or its inner wall.

According to another advantageous embodiment of the invention, the channel continuously narrows in a downstream direction form half of its length toward the opening for outflow from the hollow body. With continuous narrowing of the channel in the flow direction, a low-turbulence flow is produced by the device.

According to yet another advantageous embodiment of the invention, the chambers are separated one from another by a respective separation wall. The separation wall separates a hollow space of the hollow body in the width direction, whereby the flow of the cooling medium through the tube can be enhanced even more.

Advantageously, the separation wall extends in a direction substantially perpendicular to the width direction of the roll or the metal strip.

According to a still another embodiment of the invention, at least some of the chambers have a stream separation wall extending essentially opposite the opening for outflow of the cooling medium from the hollow body, and at least two openings located in the tube are arranged essentially opposite the opening for conducting cooling medium in the respective chambers.

The openings for conducting the cooling medium in the chambers each is provided on one of the sides of the stream separation wall for separating the cooling medium that exits the opening of the tube, so that when cooling medium exit the openings of the tube, both partial streams which are limited, respectively, by the tube and the inner wall of the hollow body, are separated from each other, and flow on opposite sides of the tube in direction of the opening for outflow of the cooling medium from the hollow body and are combined there in a common cooling medium stream.

In other words, advantageously, a partial stream in the chamber from one of the two openings of the tube is conducted in a narrowing channel between the inner wall of the hollow body and the outer wall of the tube to the outlet of the hollow body. Both partial streams are advantageously separated, in the region of the hollow body opposite the outlet of the hollow body, from each other by a stream separation wall.

According to a further embodiment, the hollow body and likewise the tube have transverse to the width direction of the roll or the metal strip, a triangular cross-section, and the outlets of the hollow body each is provided essentially at a tip of its triangular cross-section. Such shape of the hollow body or the tube can be easily produced and is extremely effective for obtaining a straightened and accelerating stream.

The distance between the inner wall of the hollow body extending in the direction of the outlet and the outer wall of the tube located opposite the inner wall advantageously diminishes in the flow direction of the cooling medium or downwardly. Further, such shape facilitates calculation or permits to predict the flow of the cooling medium through the device.

According to a yet further embodiment of the invention, of the hollow body and alternatively, the tube likewise have, transverse to the width direction of the roll or the metal strip, a drop-shaped cross-section. Here, likewise the hollow body has its outlets each is provided essentially at a tip of the drop-shaped cross-section. Such drop-shaped profile serves for producing even a smaller turbulence of the stream.

According to a still further embodiments of the invention, the inner wall of the hollow space is edge-free. Advantageously, the inner wall of the hollow space is free of projecting edges or free from projectings sharp kinks.

Further, the present invention includes a device for cooling a roll or a metal strip, including a cooling shell adjustable relative to the roll or the metal strip, at least one nozzle for feeding the cooling medium in a gap between the cooling shell and the roll or the metal strip, wherein the nozzle has an inlet region and an outlet region for the cooling medium stream. The device for cooling a roll or a metal strip also includes a device for straightening a cooling medium stream according to one of the above-described embodiments, wherein the openings for feeding the cooling medium out from the hollow body open into the nozzle inlet.

It is with such an arrangement that a straightened stream can be advantageously and efficiently used for cooling.

According to another embodiment of the device for cooling a roll or a metal strip, the outlet region of the nozzle opens into the gap between the cooling shell and the roll or the metal strip.

According to a further embodiment of the device for cooling a roll or a metal strip, the outlet region of the nozzle is connected with the cooling shell and at least partially is surrounded thereby so that the cooling medium can flow from the nozzle in the cooling shell.

Advantageously, the nozzle is arranged for directing a cooling medium stream in the gap substantially tangentially to the metal strip or roll surface.

According to a still further embodiments of the device for cooling a roll or a metal strip, the outlets of the hollow body open into the inlet region of the nozzle and, alternatively, are connected therewith.

According to a yet further embodiment of the device for cooling a roll or a metal strip, the cooling shell extends over at least a portion of a width and/or circumference of the roll. In case, a metal strip is cooled, the cooling shell extends over at least a portion of a width and/or length of the metal strip.

Generally, the outlet of the nozzle can be so arranged that the metal strip surface or the roll surface is subjected to the action of the nozzle stream in a direction opposite the movement direction.

The features of the described embodiments can be combined with each other or replaced one by the other.

SHORT DESCRIPTION OF THE DRAWINGS

Figure 2:
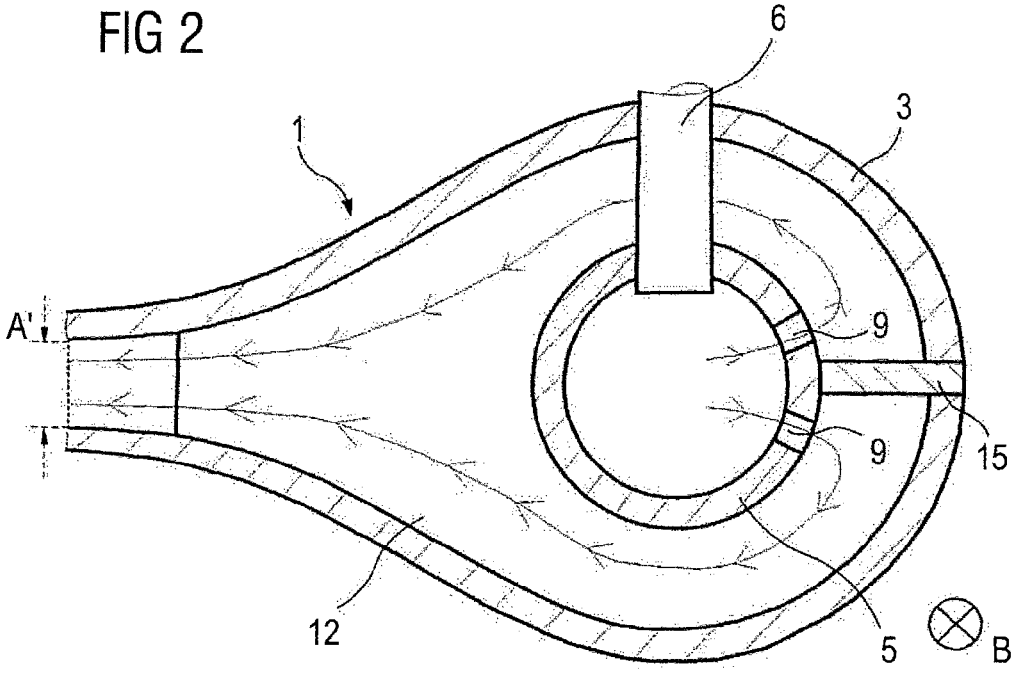
Figure 3:
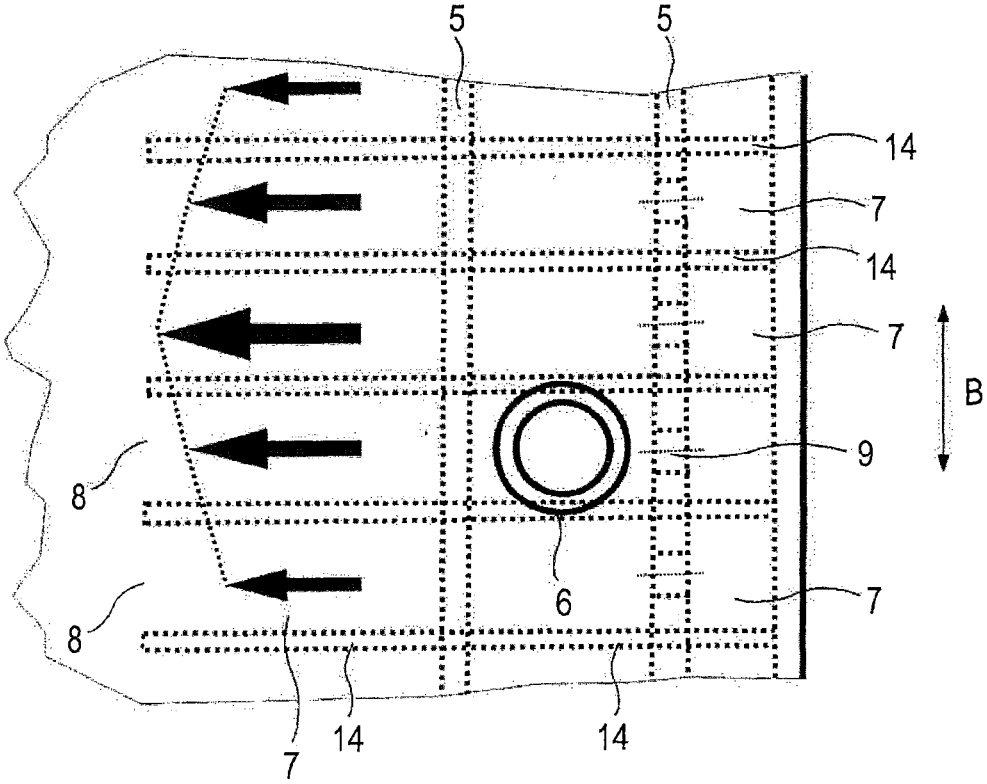
Figure 4:
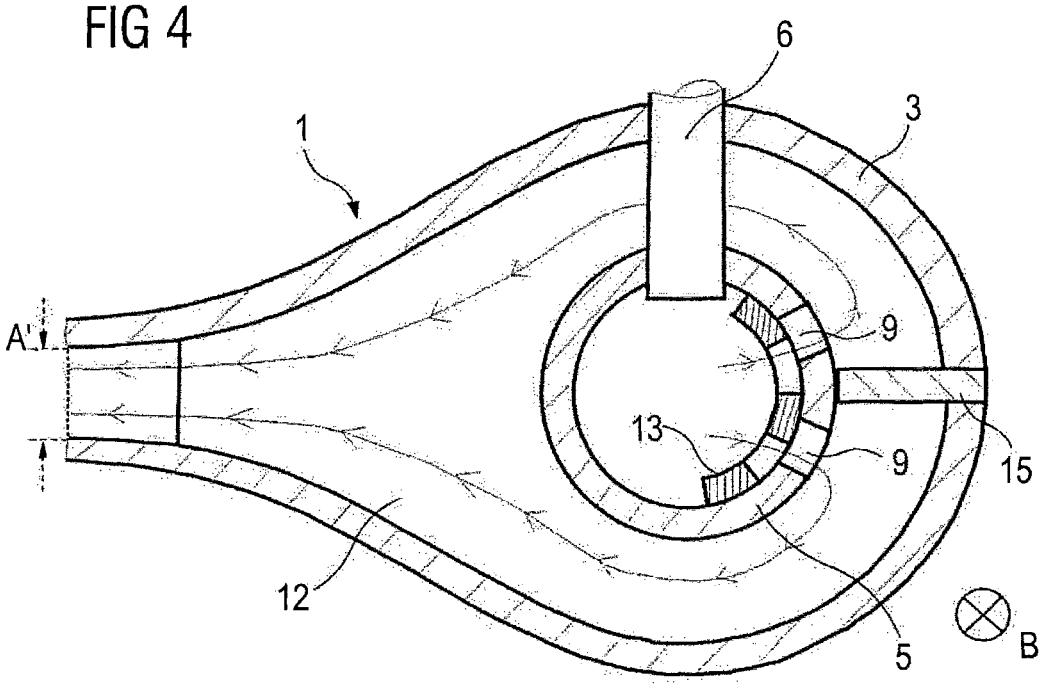
Figure 5:
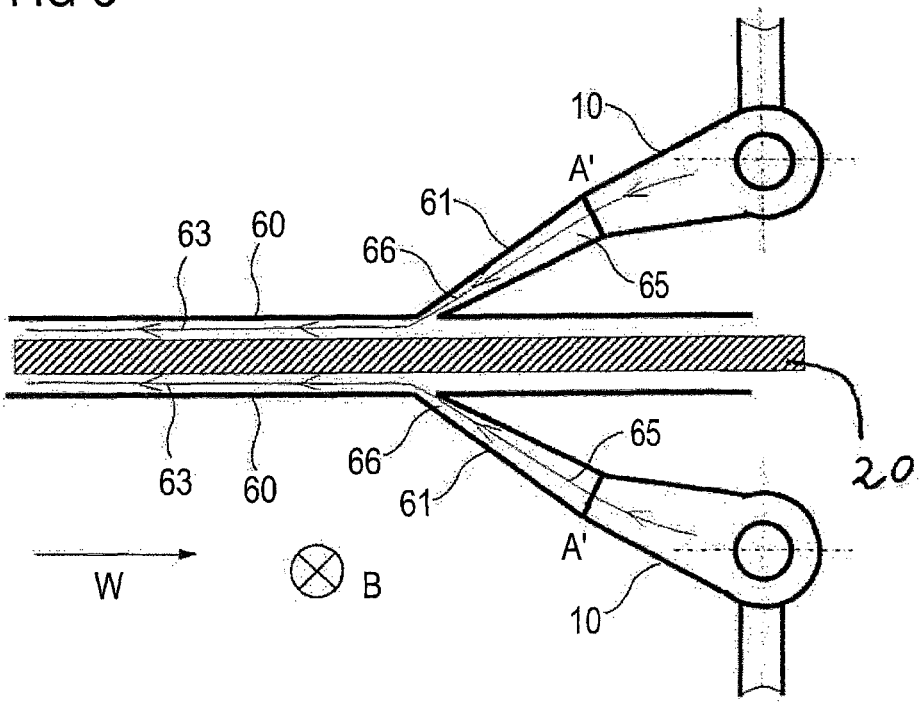
Figure 6:
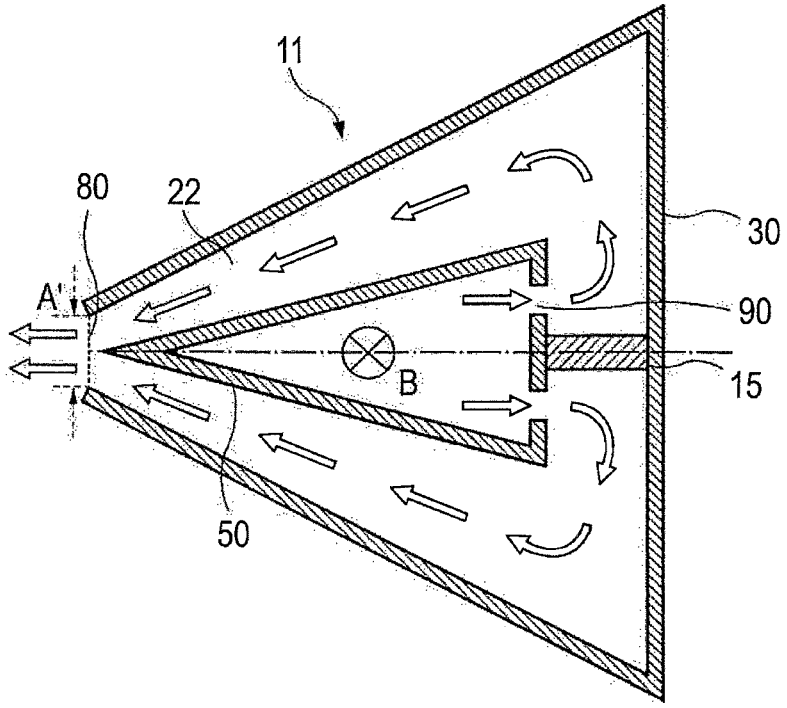
Figure 7:
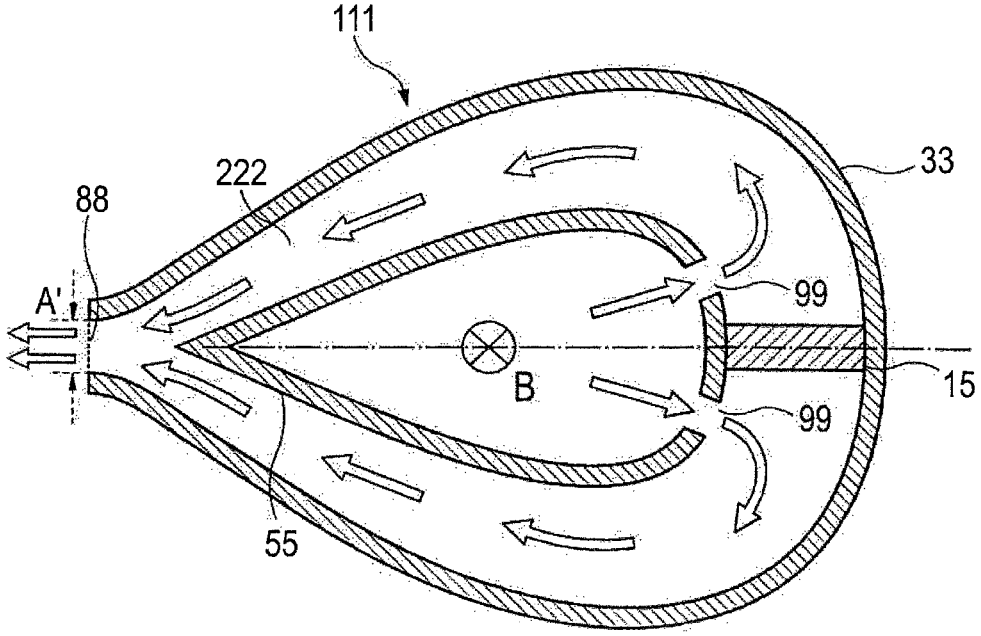

Below, the figures of the embodiments will be shortly described. Further detail will follow from the detailed description of the embodiments. The drawings show:

FIG. 1 a portion of the inventive device for cooling a roll;

FIG. 2 a cross-sectional view of a straightener according to an embodiment of the invention taken perpendicular to width direction;

FIG. 3 a schematic cross-sectional view of the straightener according to FIG. 2 in the width direction;

FIG. 4 a cross-sectional view of a straightener according to a further embodiment of the invention taken perpendicular to the width direction;

FIG. 5 a device for cooling a metal strip according to an embodiment of the invention;

FIG. 6 a cross-sectional view of a straightener according to a yet further embodiment of the invention taken perpendicular to the width direction; and FIG. 7 a cross-sectional view of a straightener according to a still further embodiment of the invention taken perpendicular to the width direction.

DETAILED DESCRIPTION OF THE EMBODIMENTS

FIG. 1 shows a portion of the inventive device for cooling a roll 2. The roll 2 can be formed as the shown work roll for rolling a metal strip 200. Such roll 2 can be supported by a backup roll 300 and be cooled, for cooling the roll surface, by cooling medium (such as, e.g., gas, air, water, oil, or by a mixture of these materials). To this end, advantageously, a cooling shell 40 is mounted on a portion of the circumference U of the roll 2. A cooling medium stream can be directed, as shown with stream lines, in the gap 43 between the roll surface and the cooling shell 40 with a nozzle 41. Here, the cooling shell 40 extends at least over a portion of the roll width in the width direction B. The width direction B here extends transverse to the rolling, or casting, or strip displacement direction W. The distance of the cooling shell 40 from the roll surface (the gap height) can be variable or adjustable. To this end, a suitable adjustment device (not shown) can be used, which, e.g., can adjust the gap distance hydraulically, pneumatically, mechanically, or electromechanically. The flow of the cooling medium stream through the gap 43 cools the roll surface.

In particular, it is desirable that the stream is as laminar as possible or not much turbulent. Reduction of the turbulence and/or reduction of the thickness of the boundary layer results in improvement of heat transfer between the roll and the cooling medium stream in the gap 43. It is further desirable to achieve as high as possible relative velocity between the stream and the to-be-cooled surface. The stream velocity noticeably influences the heat transfer coefficient and, thus, the cooling effect. To this end, the stream is preferably directed in the gap 43 in the direction opposite the rotational direction D of the roll 2.

As shown in FIG. 1, the nozzle 41 can have a narrowing shape in downstream direction for conducting the cooling medium and including an inlet region 45 and an outlet region 46. Advantageously, the nozzle 14 conducts the cooling medium along a bent line or forms a tangent to the roll surface in the gap 43. The nozzle 41 can form a portion of the cooling shell 40 or be connected therewith. Further, the nozzle 43 can extend over at least over a portion of the width of the roll 2 and/or the cooling shell 40. The nozzle 41 can be formed like a slot or by several separate nozzles arranged in the width direction B.

To prevent the cooling medium from reaching the rolled metal strip 200, a stripper 400 that has essentially a plate-shaped form, can be arranged at the downstream end of the cooling shell 40. Such a stripper can be formed, e.g., of wood, hard tissue, or metal.

For directing the cooling medium in the gap 43, the nozzle inlet 45 should be supplied with cooling medium. This can be carried out, e.g., using an inventive variant of a feeding device or a stream straightener 1, as shown in FIG. 2.

A device 1 for straightening a cooling medium stream, which is shown in FIG. 2, can advantageously have several openings 8 from which cooling medium is fed to the inlet region 45 of the nozzle 41. It is also possible that the opening 9 has the same cross-section $A^1$ as the nozzle inlet 45 (cross-section A) in order to reduce the turbulence. The device 1 advantageously includes a hollow body 3 that can extend in the width direction B. Advantageously, a distribution tube 5 that likewise extends in the width direction B and an outer diameter of which is advantageously smaller then the inner diameter of the hollow body 3, extends in the hollow body 3. The tube 5 is filled by a feeder 6. The feeder or feeding tubes 6 can be inserted in the tube 5 in any arbitrary manner, e.g., radially or axially. Further, several feeders 6 can be distributed along the tube 5 (in the width direction). The tube 5 also includes openings (e.g., bores) opening into the hollow body 3. Preferably, these openings are arranged on one side of the tube 5 located essentially opposite the opening 8 of the hollow body 3. The exact shape or the exact cross-section of the hollow body 3 or the tube 5 is irrelevant for purposes of the invention.

Advantageously, a channel 12 which is formed between the inner wall of the hollow body and the tube 5, should narrow in the direction of the opening 8 of the hollow body 3. In other words, the hollow body 3 should include a channel that narrows, at least sectionwise, toward the downstream end or narrows at the downstream end. Advantageously, the inner wall of the hollow body 3 is free of edges or from projecting corners or edges. As it is particularly shown in FIG. 2, the device 1 has a separation wall 15 that fluid-tightly extends between the side of the tube 5 opposite the opening 8 and the inner wall of the hollow body 3. Preferably, at least two outflow openings 9 in the tube 5 are so arranged that a respective outflow opening 9 directs the cooling medium from the tube 5 to a respective side of the separation wall 15.

Different outflow openings 9 of the tube 5 can have advantageously different stream cross-sections in the width direction B. On the other hand, it is possible to vary the number of openings 9 in the width direction. With a greater number of the openings 9 in the width direction or a greater cross-section of the stream of the openings 9 in the middle of the device in comparison with the ends of the device 1 in the width direction or of the tube 5, e.g., the roll middle or the strip middle can be cooled to a greater extent than the edge regions.

Advantageously, the hollow body 3 has, in its half adjacent to its opening 8, inner walls extending toward each other in the direction of the opening 8.

The cooling medium that exits from the openings 9, is in this way, advantageously separated in two partial streams and is directed between the tube 5 and the inner wall of the hollow body 3 in the direction of the opening 8 of the hollow body.

The device 1 is divided in several chambers 7 or cooling medium conducting chambers 7 in the width direction B, with FIG. 2 showing a cross-sectional view of one of the chambers 7 in the direction perpendicular to the width direction B.

The cross-sectional view in the width direction B, which is shown in FIG. 3, shows several chambers 7 arranged next to each other in the width direction which advantageously are separated from each other by separation walls 14. In other words, the separation walls 14 extend transverse to the width direction. Here, the separation walls 14 are preferably interrupted by the tube 5 or by conduits 6. Further elements of the device 1 are shown in FIG. 3 with the same reference numerals as in FIG. 2.

Advantageously, an opening 8 and two opening 9 for feeding the cooling medium in the chamber 7 are provided in at least one of the chambers 7. The openings 9 preferably are located on two sides of the stream separation wall 15. Additional openings or outlets 8, 9 are possible.

With a preferably fluid-tight segmentation or chamber-like division of the hollow body 3 in the width direction, among others, it is achieved that the stream produced by the device 1, is oriented transverse to the width direction B.

The chamber width can vary dependent on the used cooling medium. It can lie in a range, e.g., between 0.5 and 15 cm, preferably between 0.2 and 1.0 cm.

This segmentation can also serve to provide different quantities of the cooling medium or different streams in the width direction B.

In the embodiment shown in FIG. 4, the device 1 includes additionally a displaceable or pivotal orifice plate or shell 13 for varying diameters (of steam cross-sections) of openings 9 of the tube 5. It is possible to provide a separately controlled orifice plate 13. The orifice plate 13 shown in the drawings has essentially a shape at least partially complementary to the inner profile of the tube 5. Whereas the orifice plate 13 can close openings 9 by being pivoted, other shapes of the orifice plate 13, however, are also possible, e.g., stopper-like orifice plates which close the openings 9 and again open them by being displaced transverse relative to the openings 9. Alternatively, controllable valves can be provided on openings 9. Generally, the orifice plates 13 are arranged within the tube 5, however, they can also be arranged outside of the tube 5.

By controlling the means 13 for variable closing the openings 9, the volume flow rate of the cooling medium can be varied over the width. Advantageously, the orifice plates are so adjusted that the strip or roll middle is cooled, by applying a greater amount of the cooling medium, to a greater extent than the edge regions. In principle, viewing in the width direction, an edge cooling is also possible or a constant application of the cooling medium over the strip or roll width.

The adjustment of the orifice plates or valves can be carried out, e.g., mechanically, hydraulically, electrically, pneumatically and, alternatively, wirelessly.

FIG. 5 discloses another inventive embodiment of a device for cooling a metal strip 20. As shown, the metal strip 20 is displaced in the rolling direction/W that is transverse to the width direction B of the metal strip 20. A cooling shell 60 is provided at least on one of the width sides of the strip 20. In FIG. 5, two such cooling shells 60 are provided on opposite sides of the strip 20. It is possible to make the distance of the cooling shells 60 from the surfaces of the metal strip 20 adjustable. To this end, the devices analogous to those described with reference to FIG. 1, can be used. Between the cooling shell 60 and the surface of the strip, a gap 63 through which cooling medium flows, is formed. Preferably, a nozzle 61 feeds the cooling medium in the gap 63. Such a nozzle can have an inlet region 65 and an outlet region 66. As it has already been described with reference to FIG. 1, the cooling medium flows, advantageously in the direction opposite the direction of the to-be-cooled surface. Further, the cooling medium stream flows from the nozzle 61 in the gap 63 preferably tangentially to the metal strip surface. The device shown in FIG. 5 further includes the inventive device 10 for straightening the cooling medium stream. The device 10 can, e.g., correspond to one of the devices shown in FIGS. 2 through 4 and 6-7.

FIG. 6 shows a further embodiment of a straightener 11. The hollow body 30 or its inner walls has essentially a triangular cross-section. A tube 50 which functions analogously to the tube 5 in FIG. 2, is arranged in the hollow body 30. Contrary to the embodiment shown in FIG. 2, the tube 50 has a triangular cross-section. A channel 22 is formed between the inner wall of the hollow body 30 and the outer wall of the tube 50. The channel narrows in the direction from the hollow body outlet 80 or in the direction of the chamber 7. Advantageously, the tube 50 has, with regard to the opening 80 having a cross-section $A^1$, two openings 90 for conducting cooling medium form the tube 50 in the channel 20. Advantageously, a stream separation wall 15 can be provided between the two openings 90. However, it is not absolutely necessary. Thus, the cooling medium that flows out from the openings 90, can be divided in two partial streams which are directed from the hollow body 30 or the segment 7 to opposition sides of the tube 50 between the tube 50 and the inner wall of the hollow body 30 in the direction of the outlet 80.

Generally, the channel can have two (separate) channels on opposite sides of the tube. The stream cross-section can, preferably, narrow or diminish in both channels downstream or in direction of the outlet from the hollow body.

FIG. 7 shows a yet further embodiment of a stream straightener 111. Its construction is basically similar to the construction shown in FIG. 6. Though the hollow body 33 and the tube 55 have a drop shaped cross-section. Such cross-section can likewise be described by a shape that has, at one end, a round essentially semi-circular or semi-elliptical shape with the sides approaching each other and ending in a tip. The channel 222 which is formed between the tube 55 and the inner wall of the hollow body 33, opens into an outlet 88 having preferably a cross-section $A^1$ and provided essentially in the tip of the drop profile. As it has already been described with reference to other embodiments, the openings 99 which are essentially provided on a side of the tube 55 opposite to the outlet 88, are formed in the tube 55. Between at least two of the openings 99, preferably, a stream separation wall 15 is formed. With this arrangement of the tube 55 in the hollow body 33, two partial streams can be produced which extends, respectively, from respective openings 99 of the tube 55 to the outlet 88 of the hollow body 33 or to respective chambers 7. Advantageously, the stream cross-section of the channel 222 or the channels narrows at least from the half (in the flow direction) of the channel length.

Generally, the shape of the nozzle 41, 61 and/or of the device 10, 11, 111 can be optimized by numerical simulation. Further, a worker can regulate the pressure of the cooling medium or the flow rate dependent on the concrete use. The numerical simulation can take into account, e.g., pressure, flow rate, material constants of the cooling medium, or the temperature. Those can likewise depend on the shape and arrangement of the nozzle 41, 61.

The gap height between the cooling shell and the to-be-cooled roll or strip surface can be in a range between 0.1 cm and 2.5 cm and, preferably, between 0.2 cm and 1 cm.

The inlet region of the nozzle or the stream cross-section can have a clear dimension corresponding from 2 to 20 times of the gap height. The outlet region of the nozzle can have, preferably, a reduced dimension corresponding to from 1 to 3 times of the gap height.

Advantageously, the cooling medium can be fed to the device 1, 10, 11, 111 under pressure below 5 bar and, in particular, below 1 bar.

The above-described embodiments serve for better understanding of the invention and should not be understood as limiting the invention. The scope of the protection is defined by the application and the claims.

The features of the described embodiments can be combined with each other or be replaced one for another. This particular concerns the embodiments of FIGS. 2, 4, 6 and 7.

Further, the described features can be adapted to given conditions and requirements.

LIST OF REFERENCE NUMERALS

1 Stream Straightening device/Stream straightener
2 Roll/Work roll
3 Hollow body
5 Tube
6 Feeder/feed tube
7 Chamber/chambers
8 Opening for streaming or letting the cooling medium out of the tube in the hollow body
9 Opening for conducting cooling medium from the tube into the hollow body
10 Stream straightening device/stream straightener
11 Stream straightening device/stream straightener for a cooling medium stream
12 Channel
13 Orifice plate
14 Separation wall between two chambers
15 Stream separating wall in a chamber
20 Metal strip
22 Channel
33 Hollow body
40 Cooling shell
41 Nozzle
43 Slit
45 Inlet region of the nozzle
46 Outlet region of the nozzle
53 Hollow body
60 Cooling shell
61 Nozzle
63 Slit
65 Inlet region of the nozzle
66 Outlet region of the nozzle
80 Opening for streaming cooling medium from the hollow body
88 Opening for streaming cooling medium from the hollow body

90 Opening for conducting cooling medium from a tube into a chamber
99 Opening for conducting cooling medium from a tube into a chamber
111 Stream straightening device for a cooling medium stream
200 Metal strip
222 Channel
300 Backup roll
400 Stripper
A Cross-section of the inlet region of the nozzle
$A^1$ Cross-section of a stream-out opening of a stream straightener
B Width direction
D Rotation direction of the roll
U Circumferential direction of the role
W Rolling direction/strip track

The invention claimed is:

1. A device (1, 10, 11, 111) for straightening a cooling medium stream for cooling a roll (2) or a metal strip (20), comprising:

a hollow body (3, 30, 33) extending at least over a portion of a width of the roll (2) or the metal strip (20);

a tube (5, 50, 55) located in the hollow body (3, 30, 33) and extending in a width direction (B) of the roll (2) or the metal strip (20), wherein the hollow body (3, 30, 33) is divided in several chambers (7) in the width direction (B) of the roll (2) or the metal strip (20), and the tube (5, 50, 55) has openings (9, 90, 99) for feeding the cooling medium from the tube (5, 50, 55) in the chambers (7) of the hollow body (3, 30, 33), and the chambers (7) each has an opening (8, 80, 88) for outflow of the cooling medium from the hollow body (3, 30, 33), wherein the openings (9, 90, 99) of the tube (5, 50, 55) are provided essentially opposite the openings (8, 80, 88) for outflow of the cooling medium, wherein the chambers (7) are separated one from another by a respective separation wall (14) that separates a hollow space of the hollow body (3, 30, 33) in the width direction (B), while providing for flow of the cooling medium through the tube (5, 50, 55) to the chambers (7), and wherein the chambers (7) each have a channel (12, 22, 222) formed between an inner wall of the hollow body (3, 30, 33) and the tube (5, 50, 55) for conducting the cooling medium from the openings (9, 90, 99) of the tube (5) into partial cooling medium streams that flow around the tube (5, 50, 55) to the openings (8, 80, 88) for outflow of the cooling medium from the hollow body (3, 30, 33) where the partial streams are combined into a common cooling medium stream adjacent to a side of the tube (5, 50, 55) opposite the openings (9, 90, 99) of the tube (5, 50, 55), and a cross-section of the channel (12, 22, 222) continuously narrows for at least half of the length of the channel in a direction of the flow of the cooling medium up to a downstream end thereof where the partial cooling medium streams are combined into the common cooling medium stream.

2. The device according to claim 1, wherein the tube (5, 50, 55) is so arranged in an interior of the hollow body (3, 30, 33) that the cooling medium flows around a greater part of the tube.

3. A device according to claim 1, wherein the separation wall (14) essentially extends transverse to the width direction (B) of the roll (2) or the metal strip (20).

4. A device according to claim 1, wherein at least some of the chambers (7) of the hollow body (3, 30, 33) and have, transverse to the width direction (B) of the roll (2) or the metal strip (20), a triangular cross-section, and the outlets (8, 80, 88) of the chambers (7) each is provided essentially at a tip of the triangular cross-section.

5. A device according to claim 1, wherein at least some of the chambers (7) of the hollow body (3, 30, 33) have, transverse to the width direction (B) of the roll (2) or the metal strip (20), a drop-shaped cross-section, and the outlets (8, 80, 88) of the chambers (7) each is provided essentially at a tip of the drop-shaped cross-section.

6. A device according to claim 1, wherein the inner wall of the hollow body (3, 30, 33) is free from projecting edges.

7. A device according to claim 1, wherein the device further comprises means for adjusting amount of the cooling medium that flows through the openings (9, 90, 99) of the tube (5, 50, 55), and which has one or several controlled movable orifice plates (13) or at least one controlled valve.

8. A device for cooling a roll (2) or a metal strip (20), comprising:

a device (1, 10, 11, 111) for straightening a cooling medium stream and having a hollow body (3, 30, 33) extending at least over a portion of a width of the roll (2) or the metal strip (20), a tube (5, 50, 55) located in the hollow body (3, 30, 33) and extending in a width direction (B) of the roll (2) or the metal strip (20), wherein the hollow body (3, 30, 33) is divided in several chambers (7) in the width direction (B) of the roll (2) or the metal strip (20), and the tube (5, 50, 55) has openings (9, 90, 99) for feeding the cooling medium from the tube (5, 50, 55) in the chambers (7) of the hollow body (3, 30, 33), and the chambers (7) each has an opening (8, 80, 88) for outflow of the cooling medium from the hollow body (3, 30, 33)), wherein the openings (9, 90, 99) of the tube (5, 50, 55) are provided essentially opposite the openings (8, 80, 88) for outflow of the cooling medium, and wherein the chambers (7) each have a channel (12, 22, 222) formed between an inner wall of the hollow body (3, 30, 33) and the tube (5, 50, 55) for conducting the cooling medium from the openings (9, 90, 99) of the tube (5) into partial cooling medium streams that flow around the tube (5, 50, 55) to the openings (8, 80, 88) for outflow of the cooling medium from the hollow body (3, 30, 33) where the partial streams are combined into a common cooling medium stream adjacent to a side of the tube (5, 50, 55) opposite the openings (9, 90, 99) of the tube (5, 50, 55), and a cross-section of the channel (12, 22, 222) continuously narrows for at least half of the length of the channel in a direction of the flow of the cooling medium up to a downstream end thereof where the partial cooling medium streams are combined into the common cooling medium stream;

a cooling she (40, 60) adjustable relative to the roll (2) or the metal strip (20);

at least one nozzle (41, 61) for feeding the cooling medium in a gap (43, 63) between the cooling shell (40, 60) and the roll (2) or the meta strip (20), wherein the nozzle (41, 61) has an inlet region (45, 65) with a defined cross-section (A, A') of a stream therethrough, and an outlet region (46, 66) for the cooling medium stream, wherein the openings of the chambers (8, 80, 88) open in the inlet region (45, 65) of the nozzle (41, 61) for outflow of the cooling medium from the hollow body (3, 30, 33) and into the nozzle.

9. A device for cooling a roll (2) or a metal strip (20) according to claim 8, wherein the outlet region (46, 66) of the nozzle (41, 61) opens into the gap (43, 63) between the cooling shell (40, 60) and the roll (2) or the metal strip (20).

10. A device for cooling a roll (2) or the metal strip (20) according to claim 8, wherein the outlet region (46, 66) of the nozzle (41, 61) is connected with the cooling shell (40, 60) and is at least partially surrounded thereby.

11. A device for cooling a roll (2) or a metal strip (20) according to claim 8, wherein the cooling shell (40, 60) extends over at least a portion of a width and/or circumference (U) of the roll (2), or extends over at least a portion of a width and/or length of the metal strip (20) in a rolling direction (w).

12. A device for cooling a roll (2) or a metal strip (20) according to claim 8, wherein the nozzle (41) continuously narrows from the inlet region (45) to the outlet region (46).

13. A device according to claim 8, wherein the chambers (7) are separated one from another by a respective separation wall (14) that separates a hollow space of the hollow body (3, 30, 33) in the width direction (B), while providing for flow of the cooling medium through the tube (5, 50, 55) to the chambers (7).

14. A device (1, 10, 11, 111) for straightening a cooling medium stream for cooling a roll (2) or a metal strip (20), comprising:

a hollow body (3, 30, 33) extending at least over a portion of a width of the roll (2) or the metal strip (20);

a tube (5, 50, 55) located in the hollow body (3, 30, 33) and extending in a width direction (B) of the roll (2) or the metal strip (20), wherein the hollow body (3, 30, 33) is divided in several chambers (7) in the width direction (B) of the roll (2) or the metal strip (20), and the tube (5, 50, 55) has openings (9, 90, 99) for feeding the cooling medium from the tube (5, 50, 55) in the chambers (7) of the hollow body (3, 30, 33), wherein the chambers (7) each has a channel (12, 22, 222) formed between an inner wall of the hollow body (3, 30, 33) and the tube (5, 50, 55) for conducting the cooling medium from the openings (9, 90, 99) of the tube (5) to the openings (8, 80, 88) for outflow of the cooling medium from the hollow body (3, 30, 33), and a cross-section of the channel (12, 22, 222) narrows at least at a downstream-located end thereof;

wherein at least some of the chambers (7) comprise:

a stream separation wall (15) extending essentially opposite the opening (8, 80, 88) for outflow of the cooling medium from the hollow body (3, 30, 33), and at least two openings (9, 90, 99) located in the tube (5, 50, 55) are arranged essentially opposite the opening (8, 80, 88) for conducting cooling medium in the chambers (7); and wherein the openings (9, 90, 99) for conducting the cooling medium in the chambers (7) each is provided on one of the sides of the stream separation wall (15), and the stream separation wall (15) separates the cooling medium that exit the openings (9, 90, 99) of the tube (5, 50, 55) in two partial streams which are limited, respectively, by the tube (5, 50, 55) and the inner wall of the hollow body (3, 30, 33), are separated from each other, and flow on opposite sides of the tube (5, 50, 55) in direction of the opening (8, 80, 88) for outflow of the cooling medium from the hollow body (3, 30, 33), and are combined there in a common cooling medium stream.

* * * * *